US007694668B2

(12) United States Patent
Souidi et al.

(10) Patent No.: US 7,694,668 B2
(45) Date of Patent: Apr. 13, 2010

(54) SYSTEM FOR CONTROLLING THE OPERATION OF A DIESEL ENGINE OF A MOTOR VEHICLE

(75) Inventors: Faycal Souidi, Issy-les-Moulineaux (FR); Vincent Souchon, Paris (FR); Benjamin Desmarquet, Maisons-Lafifitte (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 244 days.

(21) Appl. No.: 11/574,503

(22) PCT Filed: Jul. 29, 2005

(86) PCT No.: PCT/FR2005/050631

§ 371 (c)(1),
(2), (4) Date: Feb. 28, 2007

(87) PCT Pub. No.: WO2006/027511

PCT Pub. Date: Mar. 16, 2006

(65) Prior Publication Data

US 2009/0055086 A1 Feb. 26, 2009

(30) Foreign Application Priority Data

Aug. 31, 2004 (FR) ..... 04 09231

(51) Int. Cl.
*F02B 75/08* (2006.01)
*F02D 41/00* (2006.01)

(52) U.S. Cl. ..... 123/687; 123/698

(58) Field of Classification Search ..... 123/434, 123/436, 672, 698, 681, 682, 687
See application file for complete search history.

(56) References Cited

U.S. PATENT DOCUMENTS

| | | | | |
|---|---|---|---|---|
| 5,483,934 | A | 1/1996 | Stutzenberger | |
| 6,250,291 | B1 * | 6/2001 | Kerjean et al. | 123/681 |
| 6,860,101 | B2 * | 3/2005 | Kako et al. | 60/285 |
| 2001/0009095 | A1 | 7/2001 | Salvat et al. | |
| 2002/0073981 | A1 * | 6/2002 | Coleman et al. | 123/605 |
| 2003/0070419 | A1 * | 4/2003 | Kako et al. | 60/274 |
| 2003/0110760 | A1 | 6/2003 | Shirakawa | |

FOREIGN PATENT DOCUMENTS

| | | | |
|---|---|---|---|
| DE | 10208426 | A1 | 9/2002 |
| EP | 1118751 | A | 7/2001 |
| WO | WO 0186125 | A | 11/2001 |

* cited by examiner

*Primary Examiner*—John T Kwon
(74) *Attorney, Agent, or Firm*—Nicolas E. Seckel

(57) ABSTRACT

The invention relates to a system for controlling the operation of a diesel engine of a motor vehicle, associated with means for supplying the cylinders with fuel and with means for recirculating waste gases at the admission. The control system comprises means for controlling the supply means according to the rotation speed of the engine and an effective torque control point and means for controlling the recirculating means according to the at least one effective torque control point. The system comprises means for determining a torque control point which is reconstructed from information provided by means for acquisition of the richness of the waste gas of the engine and air supply at the admission thereof and means for adjusting the means for controlling the recirculating means according to the effective torque control point and the reconstructed torque control point in order to minimize the emission of pollutants by the engine.

22 Claims, 3 Drawing Sheets

O
t0
t1
t2
t3

ES
Si
Si ±Δ S

TC
Ti
Ti ±Δ T

AT

SYSTEM FOR CONTROLLING THE OPERATION OF A DIESEL ENGINE OF A MOTOR VEHICLE

The present invention concerns a system for controlling the operation of a motor vehicle diesel engine associated with means for supplying fuel to the cylinders thereof and with means for recirculating exhaust gases to the inlet thereof, the control system comprising means for driving the supply means as a function of the rotation speed of the engine and of an effective torque control point thereof and means for driving the recirculation means as a function of at least the effective torque control point.

In a standard manner, a motor vehicle diesel engine is associated with means for supplying fuel to the cylinders thereof. These supply means comprise, for example, means forming common supply rail supplying fuel to electronic injectors of fuel into the combustion chambers of the cylinders of the engine.

A diesel engine is also associated with means for recirculating exhaust gases, also known under the name EGR system, which recycles a portion of the exhaust gases to the inlet of the engine.

These supply and recirculation means are driven in a standard manner by a unit for controlling the operation of the engine, or ECU unit.

This ECU supplies to the supply means a control point for injection of fuel into the cylinders as a function of the rotation speed of the engine and of a torque control point stemming from the driver of the vehicle, The ECU unit also supplies to the recirculation means a control point for the flow rate of air into the cylinders as a function of the rotation speed of the engine and of the torque control point stemming from the driver of the vehicle or as a function of this engine speed and of the flow rate of fuel injected into the cylinders.

If the engine has an optimal operation, the emission of pollutants by this engine is then minimized.

However, the characteristics of the injection of fuel into the cylinders, and in particular the fuel flow rate characteristics of the injectors, vary over time as a result of the state of wear and clogging thereof.

Similarly, the characteristics of the cylinders, in particular their compression rate, the permeability of the valves and of their rings, also vary over time as a result of their state of wear.

Thus, the injection driving law implemented by the ECU unit can become inappropriate after a certain time because of the sum of the drifts of the characteristics of the injectors and of the cylinders.

A degradation in the emission of pollutants by the engine is then observed.

The goal of the present invention is to remedy the above-mentioned problems by proposing a system for controlling the operation of the engine that corrects the drifts of the characteristics of the engine by adjusting the driving of the recirculation means along the life of the vehicle.

To this effect, an object of the invention is a system for controlling the operation of a motor vehicle diesel engine associated with means for supplying fuel to the cylinders thereof and with means for recirculating exhaust gases to the inlet thereof, the control system comprising means for driving the supply means as a function of the rotation speed of the engine and of an effective torque control point thereof and means for driving the recirculation means as a function of at least the effective torque control point, characterized in that it comprises:

means for determining a reconstructed torque control point from information supplied by means for acquiring the richness of the exhaust gases of the engine and the flow rate at the inlet thereof, and means for adjusting the means for driving the recirculation means as a function of the effective torque control point and of the reconstructed torque control point so as to minimize the emission of pollutants by the engine.

According to other characteristics, the system is characterized in that:

the means for determining the reconstructed torque control point comprise:

means for determining the amount of fuel injected into the cylinders of the engine as a function of the acquired richness in oxygen of the exhaust gases and air flow rate; and means for determining the reconstructed torque control point as a function of the determined fuel amount and of the engine speed;

the means for determining the amount of fuel injected into the cylinders are adapted to determine an amount of fuel injected into the cylinders for each engine cycle according to the equation:

$$Qf=A\times Ri\times Q\text{air}$$

where Qf is the amount of fuel injected into the cylinders for the engine cycle, Ri is the acquired richness in oxygen, A is a predetermined parameter, and Qair is an amount of air admitted at the inlet of the cylinder for the engine cycle predetermined as a function of the acquired air flow rate;

the means for driving the supply means are adapted to implement a first predetermined mapping of the injection of fuel into the cylinders as a function of the engine speed and of the effective torque control point, and in that the means for determining the reconstructed torque control point are adapted to reconstruct it by implementing a second mapping reversed with respect to the first one;

the means for driving the recirculation means comprise means for determining, as a function of the effective torque control point, a corrected torque control point from an effective torque control point correction mapping determined as a function of the difference between the effective torque control point and the reconstructed torque control point, and means for determining a driving control point of the recirculation means as a function of the corrected torque control point;

the effective torque control point correction mapping is determined according to the equation:

$$Carto^{+}(I,TC)=(1-\alpha)\times\Delta T+\alpha\times Carto^{-}(I,TC)$$

where TC is the effective torque control point, I is another driving input of the means (32) for driving the recirculation means, $Carto^{+}(I,TC)$ is the value of the mapping after adjustment for I and TC, $Carto^{-}(I,TC)$ is the value of the mapping before adjustment for I and TC, $\alpha$ is a predetermined filtering factor, and $\Delta T$ is a difference term determined as a function of the difference between the effective torque control point and the reconstructed torque control point;

the difference term is determined by a predetermined low-pass filtering of the instantaneous difference between the effective torque control point and the reconstructed torque control point;

the effective torque control point correction mapping is equal to the subtraction of a first mapping by a second mapping, the first mapping defining a correction of the effective torque control point for drifts over time of the operation of the engine and the second mapping defining a correction of errors related to the determination of the reconstructed torque control point by the system;

the adjustment means correct the second mapping during a predetermined phase of early life of the engine, then, consecutively to that phase, correct the first mapping;

it further comprises means for triggering the adjustment of the means for driving the recirculation means adapted to activate the means for adjusting these driving means for predetermined conditions of the operation of the engine;

a predetermined condition of the operation of the engine is a condition that the engine speed belongs to a predetermined engine speed range;

a predetermined condition of the operation of the engine is a condition that the effective torque control point belongs to a predetermined torque range;

a predetermined condition of the operation of the engine is a condition that the atmospheric pressure belongs to a predetermined pressure range;

a predetermined condition of the operation of the engine is a condition that the temperature of the cooling liquid of the engine belongs to a predetermined temperature range;

a predetermined condition of the operation of the engine is a condition that the temperature of the air belongs to a predetermined temperature range;

the engine is associated with depollution means arranged in an exhaust line thereof, and being regenerated at least regularly, and a predetermined condition of the operation of the engine is that the regeneration of the depollution means is not active;

the means for acquiring the richness in oxygen of the exhaust gases comprise a proportional λ probe arranged in the exhaust line of the engine, this probe being operational during a predetermined time period after its activation by the system for controlling the operation of the engine, and a triggering condition is that this probe is operational;

a triggering condition is the detection of the stability of the driving inputs of the means for driving the recirculation means about an input value of a predetermined group of input values;

the triggering means are adapted to compare the driving inputs of the driving means to the input value of the predetermined group of input values, and a triggering condition is that these driving inputs remain in a predetermined vicinity of the input value during at least a predetermined time period;

the triggering means check the stability of the driving inputs about the input value during the performance of the adjustment of the means for driving the recirculation means, and the adjustment means are deactivated if the driving inputs are no longer stable about the input value; and the recirculation means are further driven as a function of the rotation speed of the engine.

The invention will be better understood by reading the following description, made by way of example only and in reference to the annexed drawings, in which identical references designate identical or analogous elements, and in which.

Figure 1:
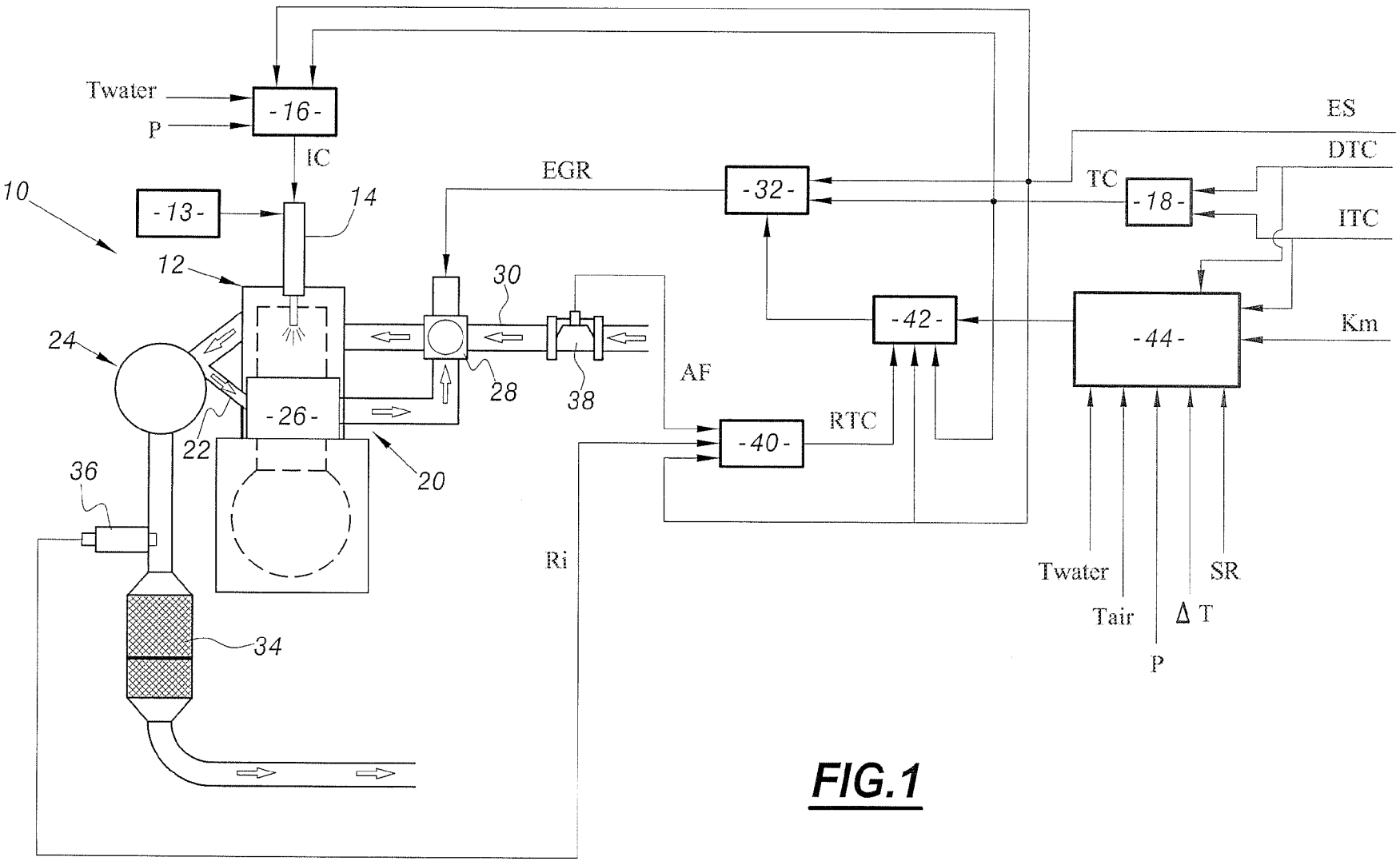
FIG. 1 is a schematic view of a system according to the invention associated with a motor vehicle diesel engine equipped with means for recirculating the exhaust gases of the type having a torque structure.

On FIG. 1 is illustrated schematically a system for controlling the operation of a motor vehicle diesel engine 10.

The engine 10 comprises cylinders 12 supplied with fuel by supply means which comprise, for example, means 13 forming common supply rail supplying fuel to driven injectors 14 associated with the cylinders 12.

The injectors 14 are driven by injection driving means 16 which supply thereto an injection control point IC as a function of the rotation speed of the engine ES, for example, supplied by an engine speed sensor, and of an effective torque control point TC therefor stemming from the driver of the vehicle, and possibly of other information, such as, for example, the temperature Twater of the cooling liquid of the engine and the atmospheric pressure P.

More particularly, the injection driving means 16 are adapted to drive the injectors 14 so that they supply to the cylinders 12, for each engine cycle, multiple fuel injections, for example, a main injection, a pilot injection, and post-injections. To this effect, the driving means 16 evaluate, for the engine speed ES and the effective torque control point TC and at each engine cycle, a predetermined mapping associated with each type of injections, as this is known in itself in the state of the art.

The effective torque control point TC, in an advantageous manner, stems from a preliminary filtering of a torque control point DTC supplied by the driver of the vehicle, for example, by means of an acceleration pedal. This filtering is performed by filtering means 18 which select the maximum between the driver's torque control point DTC and an idle torque control point ITC, with a view at a satisfactory control of the idle of the engine 10, for example.

The diesel engine 10 is also associated with means 20 for recirculating the exhaust gases to the inlet thereof. These means 20 comprise, for example, a derivation 22 of an exhaust line 24 of the engine to remove a portion of the exhaust gases by means of a conduit 26, and means 28 for intake of the air/exhaust gases mixture at the inlet of the engine 10 receiving the removed exhaust gases and air in the area of an air inlet 30.

The exhaust gases recirculation means 20 are driven by driving means 32 adapted to supply an EGR driving control point, for example, an air flow rate control point, to the intake means 28 as a function of the effective torque control point TC.

In the example illustrated here, the recirculation means 20 are also driven as a function of the rotation speed ES of the engine, the recirculation means 20 being therefore called recirculation means of the "torque structure" type. The driving means 32 thus receive the torque control point TC and the engine speed ES and supply to the recirculation means 20 the EGR driving control point as a function thereof.

The means 32 for driving the recirculation means determine in particular the EGR driving control point as a function of a predetermined driving law of the air/exhaust gases intake, for example, implemented in the form of a predetermined mapping of EGR driving control points as a function of engine speed and torque values, as this will be explained in more details below.

Finally, the diesel engine 10 is associated with depollution means 34, arranged in the exhaust line 24 and being regularly and/or periodically regenerated, as this is known in itself in the state of the art.

The driving laws implemented by the driving means 16 and 32 are, in a general manner, determined ex works.

However, the characteristics of the engine 10, and in particular the characteristics of its injectors 14 and of its cylinders 12, vary over time, as a function, for example, of the clogging of the injectors 14, of the permeability of the valves and rings of the cylinders 12, etc.

Thus, after a certain time, the operation of the engine 10 can be disrupted as a result of the fact that the driving laws of the means 16 and 32 are no longer adapted to the actual characteristics of the injectors 14 and of the cylinders 12.

A degradation of the emission of the pollutants emitted by the engine 10 is then observed.

In an advantageous manner, the engine 10 is associated with a system for controlling its operation conform to the invention, adapted to correct such drifts by adjusting the operation of the recirculation means 20 by the adjustment of the driving means 32 associated therewith.

To this effect, the system for controlling the operation of the engine 10 comprises means 36 for acquiring the richness in oxygen Ri of the exhaust gases, for example, a proportional λ probe arranged in the exhaust line 24 of the engine 10, and means 38 for acquiring the air flow rate AF at the inlet of the engine 10, for example, a flowmeter arranged in the area of the air inlet 30 of the air/exhaust gases intake means 28.

The system comprises determination means 40 adapted to reconstruct a torque control point at the input of the driving means 16 as a function of the acquired richness in oxygen Ri of the exhaust gases and of the acquired air flow rate AF, in a manner that will be explained in more details below.

When the injectors 14, the cylinders 12, and the driving means 16 operate together in an optimal way, the engine torque, induced by the effective torque control point TC, is equal to the effective torque control point TC.

However, as a result of the above-mentioned drifts, the engine torque is not equal to that control point, but is, for example, equal to T≠ TC. Nevertheless, it can be considered that the engine torque T corresponds to the engine torque resulting from an effective torque control point RTC that would be supplied to an engine operating in an optimal way, i.e., exhibiting no drift.

The difference between the effective torque control point TC and the effective torque control point RTC of an engine operating in an optimal way makes it thus possible to characterize the drifts over time of the injectors 14 and of the cylinders 12.

In an advantageous manner, the means 40 are adapted to reconstruct such a torque control point RTC as a function of the acquired richness in oxygen Ri and of the acquired air flow rate AF, as this will be explained in more details below.

The reconstructed torque control point RTC and the effective torque control point TC are supplied to means 42 for adjusting the means 32 for driving the recirculation means 20. These adjustment means 42 are adapted to adjust the driving means 32 as a function thereof to make the EGR control point supplied by the means 32 for driving the recirculation means 20 tend toward an EGR control point corresponding to the reconstructed torque control point RTC.

Consequently, the drifts of the engine are then corrected and the operation of the engine 10 is optimized from the point of view of the emission of pollutants.

Finally, the system according to the invention also comprises means 44 for triggering the adjustment implemented by the adjustment means 42. The triggering of the adjustment is performed as a function of predetermined conditions of the operation of the engine 10.

The triggering of the adjustment is performed in order to optimize the execution of the adjustment and also in order to take into account particular characteristics of the control of the operation of the engine 10, for example, driving laws implemented by the means 16, 32 of the driving and recirculation means, as this will be explained in more details below.

Figure 2:
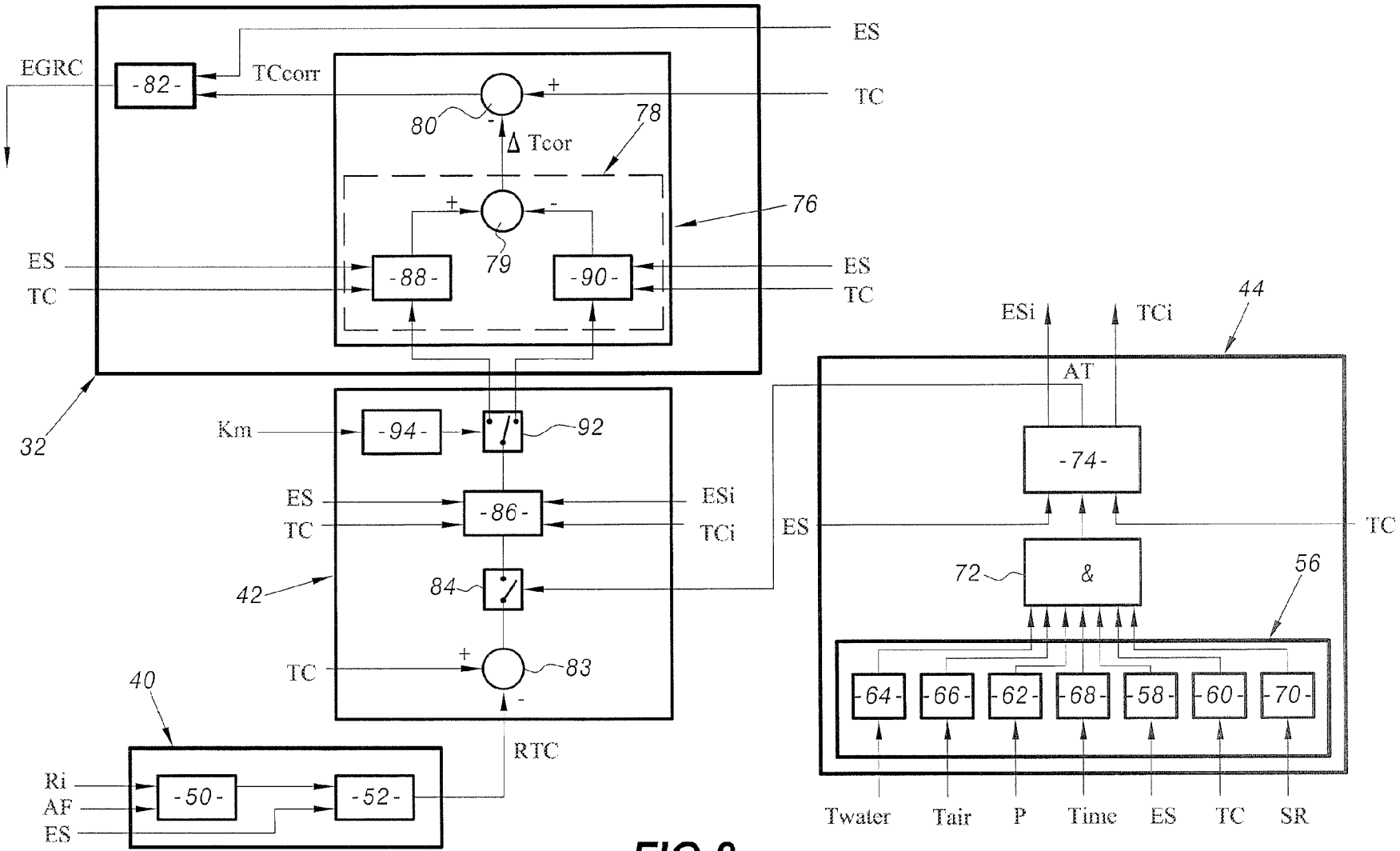
FIG. 2 is a schematic view in more details of the system of FIG. 1.

The arrangement and the operation of the control system according to the invention will now be described in more details, in reference to FIG. 2.

The means 40 for determining the reconstructed torque control point RTC comprise means 50 for determining the amount of fuel Qf injected into the cylinders of the engine for each engine cycle. The means 50 are adapted to determine, as a function of the acquired air flow rate AF, the amount of air Qair admitted at the inlet of the engine for the engine cycle, for example, by integrating the air flow rate AF acquired over the engine cycle. The means 50 are also adapted to determine the amount of fuel Qf injected into the cylinders for the engine cycle according to the equation:

$$Qf = \frac{12 + y}{\left(1 + \frac{y}{4}\right)x(32 + 28\psi)} \times Ri \times Qair$$

where y is the H/C ratio of the fuel, and x is the ratio between the $N_2$ concentration and the $O_2$ concentration of the air.

The determined amount Qf and the engine speed ES are supplied to means 52 for determining the reconstructed torque control point RTC as a function thereof.

More particularly, in a typical manner, the injection control point IC supplied by the driving means 16 to the injectors 14 consists in a control point of multiple injections into the cylinders, for example, a pilot injection, a main injection, and a post-injection. These injections are determined from respective predetermined mappings for the engine speed ES and the effective torque control point TC, as this is known in itself in the state of the art.

By grouping these mappings together, an equivalent mapping Qf=carto1(ES,TC) of the injection of fuel amount into the cylinders of the engine by engine cycle is then obtained as a function of the engine speed ES and of the effective torque control point TC.

In an advantageous manner, the determination means 52 are adapted to reconstruct the torque control point RTC by evaluating a predetermined mapping RTC=carto2(ES,Qf) for the determined amount of fuel Qf and the engine speed ES, where the mapping carto2=$(\text{carto1})^{-1}$ is the reverse of the equivalent injection mapping.

Before describing in more details the manner in which the adjustment of the driving means 32 is performed, the conditions for triggering it will be described below.

The adjustment of the means 32 for driving the recirculation means 20 is subjected to certain predetermined conditions of operation of the engine 10, monitored by triggering means 44.

A first type of operating conditions of the engine are general operating conditions hereof which are monitored by monitoring means 56.

These operating conditions are thus designated because they must be satisfied independently from the type of driving laws of the driving means 16 and 32 in order to avoid an unsatisfactory adjustment of the driving means 32. These conditions concern, for example, the fact that the vehicle is not in altitude or in an initialization process, that the PF is not in regeneration phase, that the means for acquiring the richness in oxygen of the exhaust gases is not in initialization phase, etc. Thus, by ensuring that the general operating conditions are satisfactory, the system according to the invention ensures the scope of application of the adjustment strategy that it implements.

To this effect, the monitoring means 56 comprise more particularly:

means 58 for comparing the engine speed ES to a predetermined range of engine speeds, for example, the range [700;3,500] rev/min;

means 60 for comparing the effective torque control point TC to a predetermined range of engine torques, for example, the range [0;200] Nm;

means 62 for comparing the atmospheric pressure P to a predetermined range of atmospheric pressures, for example, the range [950;1,030] mb;

means 64 for comparing the temperature of the cooling liquid of the engine Twater to a predetermined range of cooling liquid temperatures, for example, the range [70;100] ° C.;

means 66 for comparing the temperature of the air admitted at the inlet of the engine Tair to a predetermined range of air temperatures, for example, the range [0;40] ° C.;

means 68 for monitoring the operational state of the proportional λ probe used to acquire the richness in oxygen Ri of the exhaust gases. In a typical manner, this probe is operational for a predetermined time period after its activation by the control system according to the invention, and the means 68 are adapted to monitor the time elapsed since the activation of the probe and to determine that the probe is operational, for example, 20 seconds after its activation; and means 70 for monitoring the state of the depollution means 34, adapted to monitor the regeneration phase thereof.

The output of the various means 58 to 70 are supplied to means 72 performing the logical operation AND, so that a first necessary condition for the triggering of the adjustment is that the engine speed ES, the effective torque control point TC, the atmospheric pressure, the temperature of the cooling liquid, the temperature of the air at the inlet of the engine, are comprised in their respective associated ranges and that the regeneration phase of the depollution means 34 is not active and that the proportional probe is operational.

A second type of operating conditions of the engine concerns conditions of stability of the operation of the engine about predetermined operation points, and more particularly, operation points associated with the driving law of the means 32 for driving the recirculation means.

As will be explained in more details below, the driving means 32 use an effective torque control point correction mapping to correct the effective torque control point supplied to the EGR driving control point mapping. This effective torque control point correction mapping is constituted by predetermined torque control point correction values associated with predetermined couples of engine speed and torque values, i.e., constituted by a discrete group of values associated with a discrete group of couples of values.

As a consequence, the adjustment means 42 are then adapted to adjust the values of this mapping, as this will also be explained in more details below.

It will thus be understood that, to adjust the driving means 32, the engine speed ES and the effective torque control point TC must be substantially equal to, i.e., in the vicinity of, a couple of values (engine speed, torque) of the effective torque control point correction mapping for which an adjustment is performed, for the duration of the adjustment implemented by the adjustment means 42.

In addition, if the engine speed ES and the effective torque control point TC are stable during the adjustment, it is then ensured that the delays in the transmission of the information, for example, caused by the transmission time of the gases or the reaction time of the sensors, are without importance, so that the measurements are substantially equal to their actual physical magnitudes.

In order to monitor the stability of the engine 10, the output of the means 72 is supplied to means 74 for monitoring static conditions of the engine 10. The means 74 are activated when the general operating conditions of the engine are validated.

The monitoring means 74 are adapted to compare the engine speed ES and the effective torque control point TC to the couples of the effective torque control point correction mapping. The means 74 then monitor whether the couple (ES, TC) remains stable about one of these couples during at least a predetermined time period stab_time, and then trigger the adjustment of the driving means 32 for this couple, if this is the case.

For example, the means 74 test whether the engine speed ES and the control point TC are comprised in the intervals [Si−ΔS; Si+ΔS] and [Ti−ΔT; Ti+ΔT], respectively, during stab_time, where Si and Ti are engine speed and engine torque values of a couple of the effective torque control point correction mapping, respectively, and ΔS and ΔT are predetermined positive tolerances.

If the monitoring means 74 detect such a stability, then they deliver to the adjustment means 42 an adjustment triggering signal AT and the values Si and Ti of the couple of the mapping for an adjustment of the driving means 32 thereof.

Of course, other conditions can be monitored, such as, for example, the temperature of the cooling liquid, the atmospheric pressure, or others.

FIGS. 3A to 3D are chronograms illustrating an example of operation of the adjustment triggering means 44.

Figures 3A, 3B, 3C, 3D:
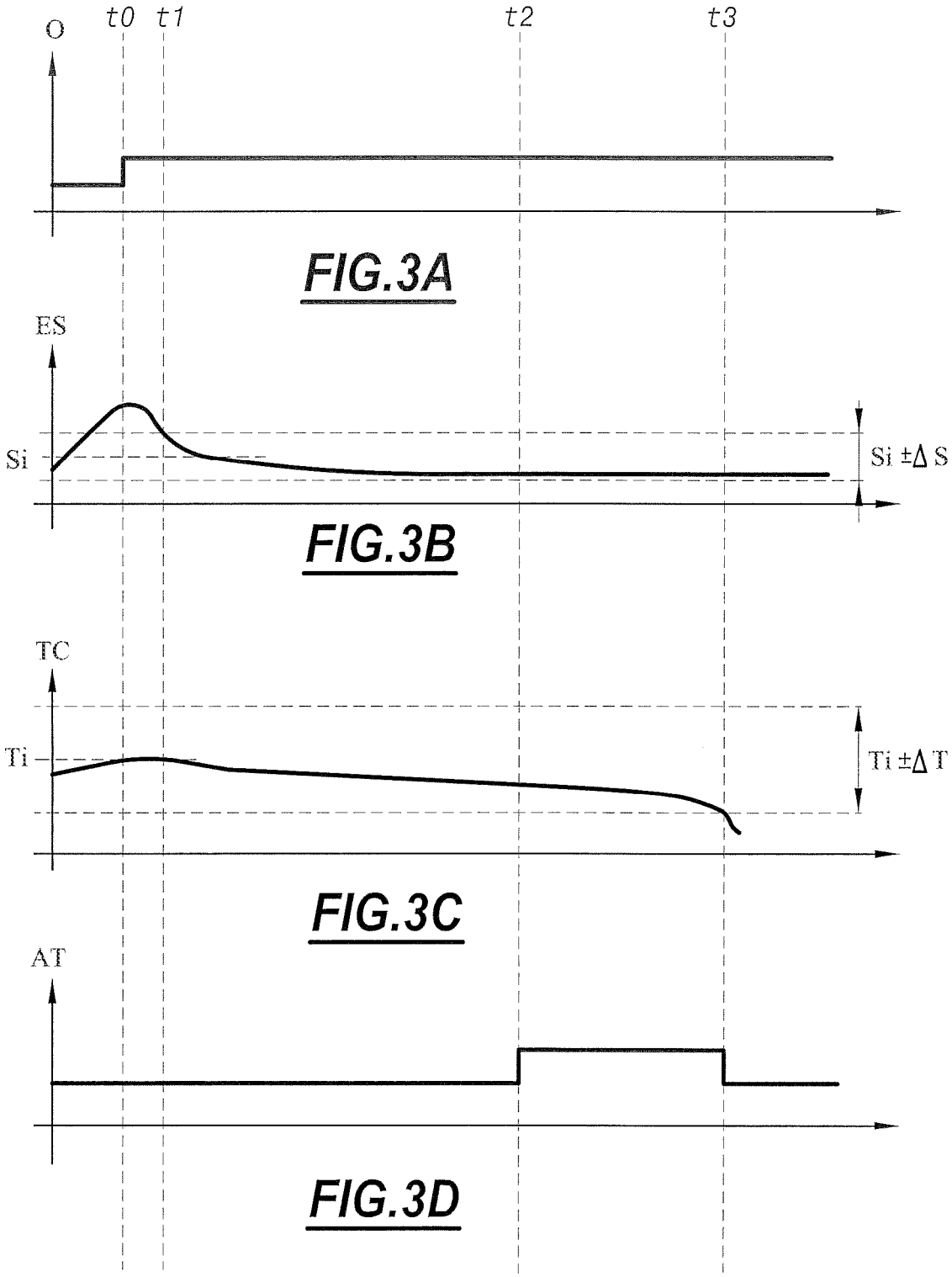
FIG. 3 is a chronogram illustrating the triggering of the adjustment means that are part of the construction of the system of FIG. 2.

FIG. 3A is a graph of the output 0 of the means 72 performing the AND function.

FIGS. 3B and 3C are two examples of evolution of the engine speed ES and of the effective torque control point TC, respectively, and FIG. 3D is the corresponding evolution of the signal AT triggering the adjustment of the driving means 32.

At the time t0, the general operating conditions of the engine tested by the monitoring means 56 are validated and the monitoring means 74 are activated.

At the time t1, the engine speed ES and the effective torque control point TC are simultaneously substantially equal to the engine speed and engine torque values Si and Ti, respectively, of a couple (Si, Ti) of the torque control point correction mapping, i.e., comprised in the intervals [Si−ΔS; Si+ΔS] and [Ti−ΔT; Ti+ΔT], respectively.

The engine speed ES and the control point TC remain substantially equal to the couple (Si, Ti) during stab_time after the time t1, so that at the time t2=t1+stab_time, the signal AT becomes high. The adjustment means 42 are then activated and receive the couple (Si, Ti) for the adjustment of the driving means 32 thereof.

At the time t3, the effective torque control point TC is no longer comprised in the interval [Ti−ΔT; Ti+ΔT]. The signal AT is then adjusted to the low level. If the adjustment means 42 have not executed the totality of the adjustment, i.e., if t3−t2 is less than the sum of the time for gathering the measurements, the time for calculating the adjustment algorithm and the time for memorizing the adjustment results, the means 42 are thus deactivated and do not finish their adjustment of the driving means 32.

Referring again to FIG. 2, the arrangement and the operation of the means 32 for driving the recirculation means 20 and of the adjustment means 42 thereof will now be described in more details.

The driving means 32 comprise means 76 for determining a corrected torque control point TCcor as a function of the engine speed ES and of the effective torque control point TC.

To this effect, the means 76 comprise means 78 forming effective torque control point correction mapping. The means 78 forming mapping receive the engine speed ES and the control point CC and evaluate for them a predetermined effective torque control point correction mapping to generate a correction value ΔTcor. The value ΔTcor of the mapping is adjusted regularly and/or periodically to correct the drifts of the operation of the engine and thus ensure the optimal operation thereof.

The value ΔTcorr is supplied to an adder 80 which also receives the effective torque control point TC. The adder 80 supplies the corrected torque control point TCcor=TC+ΔTcor to means 82 forming EGR driving control point mapping which evaluate therefore and the engine speed ES, the EGR driving control point mapping to determine and supply to the intake means 28 of the recirculation means 20, the corresponding EGR driving control point.

Since the drifts of the operation of the engine evolve with time, it is necessary to adjust the effective torque control point correction performed by the means 76 so as to compensate these drifts in the course of the life of the vehicle.

To this effect, the adjustment means 42 of the driving means 32 of the recirculation means 20 are adapted to adjust the effective torque control point correction mapping as a function of the difference between the effective torque control point TC and the reconstructed torque control point RTC.

The adjustment means 42 comprise means 83 for forming the difference between the effective TC and reconstructed RTC effective torque control points. This difference between control points is, for example, supplied to a switch 84 controlled as a function of the adjustment triggering signal AT supplied by the triggering means 44.

The switch 84 switches to the closed state when the general conditions and the static conditions of operation of the engine are verified, thus enabling the difference between the torque control points TC-RTC to be supplied to means 86 for correcting the effective torque control point correction mapping. The difference between the torque control points TC-RTC is, for example, sampled by the means 83 for forming the difference which comprise to this effect an analog/digital converter, or the whole control system according to the invention is discrete, for example.

The correction means 86 also receive the value of the effective torque control point correction mapping for the engine speed ES and the control point TC and are adapted to correct this correction mapping according to the equation:

$$Carto^{+}(ES,TC)=(1-\alpha)\times\Delta T+\alpha\times Carto^{-}(ES,TC)$$

where Carto+(ES,TC) is the value of the torque control point correction mapping for the engine speed ES and the control point TC after correction, Carto⁻(ES,TC) is the value of this same mapping for the engine speed ES and the control point TC before correction, α is a predetermined filtering factor, and ΔT is a difference term determined as a function of the difference between the effective TC and reconstructed RTC torque control points.

As explained above, the correction of the control point mapping is performed for an engine speed ES and an effective torque control point TC equal to a couple (Si, Ti) of the effective torque control point correction mapping which has been determined by the triggering means 44.

For example, the value of the term ΔT is determined by a predetermined low-pass filtering of the instantaneous difference between the effective torque control point TC and the reconstructed torque control point RTC.

The means 86 memorize N values of the difference between the control points TC and RTC, then determine the difference term ΔT as the average of these N differences.

Of course, other types of low-pass filtering can be envisioned, such as low-pass filtering of order 1 or above.

In an advantageous manner, the means 74 for monitoring the static operating conditions of the engine 10 are always active and thus keep checking the stability of the couple (ES, TC) about the selected couple (Si, Ti).

If the couple (ES, TC) leaves the range [Si−ΔS; Si+ΔS] and [Ti−ΔT; Ti+ΔT], i.e., if the stability thereof is not obtained, then the means 74 supply a signal AT deactivating the adjustment being performed.

In an advantageous manner, the system according to the invention takes into account its own mistakes in the calculation of the reconstructed torque control point, for example, caused by an imprecise knowledge of the characteristics of the air flow rate, of the richness in oxygen, or others.

To this effect, the effective torque control point correction mapping is formed by the subtraction of a first mapping 88 by a second correction mapping 90 which are initialized at 0 the first time the engine is started.

The adjustment means 42 then comprise means 92, 94 for selecting the mapping to be corrected. These means 92, 94 comprise, for example, a driven switch 92 and means 94 for comparing the mileage of the vehicle to a predetermined mileage value, for example, 3,000 km. If the mileage is lower than this value, a second mapping 90 is selected by the switch 92 and is corrected by the correction means 86.

If the mileage value is higher than a predetermined mileage value, then the first mapping 88 is selected by the switch 92 and is corrected by the correction means 86.

In a typical way, the effective torque control point TC supplied to the engine 10 at the beginning of the life thereof is optimal for the emission of the pollutants as a result of the fact that the engine 10 operates in an optimal manner. Thus, the difference between the effective torque control point TC and the reconstructed torque control point RTC is representative of errors in the determination thereof by the system itself. The adjustment of the second mapping 90 during the optimal operation of the engine 10 makes it thus possible to take into account such errors.

Thus, the first mapping 88 is representative of the sole drifts of the operation of the engine over time.

In an advantageous manner, the system also corrects the drifts in the operation of the flowmeter 38 arranged in the air inlet 30 of the air intake means 28.

Of course, the fuel supply means of the engine, the exhaust gases recirculation means to the inlet thereof, and the driving means thereof, can be structurally different from those described above and/or operate in a different manner.

Embodiments of the system according to the invention are then adapted to the characteristics of the engine while remaining within the scope of the invention which is to correct the drifts of the operation of the engine by adjusting the recirculation means.

The invention claimed is:

1. System for controlling the operation of a motor vehicle diesel engine associated with means for supplying fuel to the cylinders thereof and with means for recirculating exhaust gases to the inlet thereof, the control system comprising:

means for driving the supply means as a function of the rotation speed of the engine and of an effective control point of the torque thereof stemming from a driver of the vehicle, means for driving the recirculation means as a function of at least the effective torque control point, means for determining a reconstructed torque control point from information supplied by means for acquiring the richness of the exhaust gases of the engine and the flow rate at the inlet thereof, wherein the reconstructed torque control point corresponds to the engine torque resulting from an effective torque control point that would be supplied to an engine operating in an optimal way, so that a difference between the effective control point and the reconstructed torque control point results from drifts over time of characteristics of the engine; and means for adjusting the means for driving the recirculation means as a function of the effective torque control point and of the reconstructed torque control point so as to minimize the emission of pollutants emitted by the engine.

2. System according to claim 1, wherein the means for determining the reconstructed torque control point comprise:

means for determining the amount of fuel injected into the cylinders of the engine as a function of the acquired richness in oxygen of the exhaust gases and air flow rate; and means for determining the reconstructed torque control point as a function of the determined fuel amount and of the engine speed.

3. System according to claim 2, wherein the means for determining the amount of fuel injected into the cylinders are adapted to determine an amount of fuel injected into the cylinders for each engine cycle according to the equation:

$$Qf=A\times Ri\times Q\text{air}$$

where Qf is the amount of fuel injected into the cylinders for the engine cycle, Ri is the acquired richness in oxygen, A is a predetermined parameter, and Qair is an amount of air admitted at the inlet of the cylinder for the engine cycle predetermined as a function of the acquired air flow rate.

4. System according to claim 1, wherein the means for driving the supply means are adapted to implement a first predetermined mapping of the injection of fuel into the cylinders as a function of the engine speed and of the effective torque control point, and the means for determining the reconstructed torque control point reconstruct the reconstructed torque control point by implementing a second mapping reversed with respect to the first one.

5. System according to claim 1, wherein the means for driving the recirculation means comprise means for determining, as a function of the effective torque control point, a corrected torque control point from an effective torque control point correction mapping determined as a function of the difference between the effective torque control point and the reconstructed torque control point, and means for determining a driving control point of the recirculation means as a function of the corrected torque control point.

6. System according to claim 5, wherein the effective torque control point correction mapping is determined according to the equation:

$$Carto^{+}(I,TC)=(1-\alpha)\times\Delta T+\alpha\times Carto^{-}(I,TC)$$

where TC is the effective torque control point, I is another driving input of the means for driving the recirculation means, $Carto^{+}(I,TC)$ is the value of the mapping after adjustment for I and TC, $Carto^{-}(I,TC)$ is the value of the mapping before adjustment for I and TC, $\alpha$ is a predetermined filtering factor, and $\Delta T$ is a difference term determined as a function of the difference between the effective torque control point and the reconstructed torque control point.

7. System according to claim 5, wherein the difference term is determined by a predetermined low-pass filtering of the instantaneous difference between the effective torque control point and the reconstructed torque control point.

8. System according to claim 5, wherein the effective torque control point correction mapping is equal to the subtraction of a first mapping by a second mapping, the first mapping defining a correction of the effective torque control point for drifts over time of the operation of the engine and the second mapping defining a correction of errors related to the determination of the reconstructed torque control point by the system.

9. System according to claim 8, wherein the adjustment means correct the second mapping during a predetermined phase of early life of the engine, then, consecutively to that phase, correct the first mapping.

10. System according to claim 1, wherein it further comprises means for triggering the adjustment of the means for driving the recirculation means adapted to activate the means for adjusting these driving means for predetermined conditions of the operation of the engine.

11. System according to claim 10, wherein a predetermined condition of the operation of the engine is a condition that the engine speed belongs to a predetermined engine speed range.

12. System according to claim 10, wherein a predetermined condition of the operation of the engine is a condition that the effective torque control point belongs to a predetermined torque range.

13. System according to claim 10, wherein a predetermined condition of the operation of the engine is a condition that the atmospheric pressure belongs to a predetermined pressure range.

14. System according to claim 10, wherein a predetermined condition of the operation of the engine is a condition that the temperature of the cooling liquid of the engine belongs to a predetermined temperature range.

15. System according to claim 10, wherein a predetermined condition of the operation of the engine is a condition that the temperature of the air belongs to a predetermined temperature range.

16. System according to claim 10, wherein the engine is associated with depollution means arranged in an exhaust line thereof and being regenerated at least regularly, and in that a predetermined condition of the operation of the engine is that the regeneration of the depollution means is not active.

17. System according to claim 10, wherein the means for acquiring the richness in oxygen of the exhaust gases comprise a proportional $\lambda$ probe arranged in the exhaust line of the engine, this probe being operational during a predetermined time period after its activation by the system for controlling the operation of the engine, and in that a triggering condition is that this probe is operational.

18. System according to claim 10, wherein a triggering condition is the detection of the stability of the driving inputs of the means for driving the recirculation means about an input value of a predetermined group of input values.

19. System according to claim 18, wherein the triggering means are adapted to compare the driving inputs of the driving means to the input value of the predetermined group of input values, and in that a triggering condition is that these driving inputs remain in a predetermined vicinity of the input value during at least a predetermined time period.

20. System according to claim 18, wherein the triggering means check the stability of the driving inputs about the input value during the performance of the adjustment of the means for driving the recirculation means, and in that the adjustment means are deactivated if the driving inputs are no longer stable about the input value.

21. System according to claim 1, wherein the recirculation means are further driven as a function of the rotation speed of the engine.

22. System for controlling the operation of a motor vehicle diesel engine associated with means for supplying fuel to the cylinders thereof and with means for recirculating exhaust gases to the inlet thereof, the control system comprising means for driving the supply means as a function of the rotation speed of the engine and of an effective control point of the torque thereof and means for driving the recirculation means as a function of at least the effective torque control point, wherein it comprises:

means for determining a reconstructed torque control point from information supplied by means for acquiring the richness of the exhaust gases of the engine and the flow rate at the inlet thereof; and means for adjusting the means for driving the recirculation means as a function of the effective torque control point and of the reconstructed torque control point so as to minimize the emission of pollutants emitted by the engine, wherein the means for driving the recirculation means comprise means for determining, as a function of the effective torque control point, a corrected torque control point from an effective torque control point correction mapping determined as a function of the difference between the effective torque control point and the reconstructed torque control point, and means for determining a driving control point of the recirculation means as a function of the corrected torque control point, wherein the effective torque control point correction mapping is determined according to the equation:

$$Carto^{+}(I,TC)=(1-\alpha)\times\Delta T+\alpha\times Carto^{-}(I,TC)$$

where TC is the effective torque control point, I is another driving input of the means for driving the recirculation means, $Carto^{+}(I,TC)$ is the value of the mapping after adjustment for I and TC, $Carto^{-}(I,TC)$ is the value of the mapping before adjustment for I and TC, $\alpha$ is a predetermined filtering factor, and $\Delta T$ is a difference term determined as a function of the difference between the effective torque control point and the reconstructed torque control point.

* * * * *